US007020295B2

(12) United States Patent
Hamada et al.

(10) Patent No.: US 7,020,295 B2
(45) **Date of Patent: *Mar. 28, 2006**

(54) PIEZOELECTRIC ELECTROACOUSTIC TRANSDUCER AND MANUFACTURING METHOD OF THE SAME

(75) Inventors: Kazuaki Hamada, Toyama-ken (JP); Masayuki Fujino, Toyama (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 172 days.

This patent is subject to a terminal disclaimer.

(21) Appl. No.: 10/192,493

(22) Filed: Jul. 11, 2002

(65) Prior Publication Data

US 2003/0021458 A1 Jan. 30, 2003

(30) Foreign Application Priority Data

Jul. 11, 2001 (JP) ..... 2001-210233

(51) Int. Cl.
*H04R 25/00* (2006.01)

(52) U.S. Cl. ..... 381/190; 381/162; 381/386; 381/173; 381/433; 310/322; 310/348

(58) Field of Classification Search ..... 381/152, 381/190, 162, 386, 173, 431, 433; 439/660, 439/77; 310/322, 324, 348, 349
See application file for complete search history.

(56) References Cited

U.S. PATENT DOCUMENTS

| | | | | |
|---|---|---|---|---|
| 5,770,915 A | * | 6/1998 | Sumita et al. | 310/348 |
| 6,445,108 B1 | * | 9/2002 | Takeshima et al. | 310/322 |
| 6,570,299 B1 | * | 5/2003 | Takeshima et al. | 310/348 |
| 6,587,567 B1 | * | 7/2003 | Yamamoto | 381/190 |
| 2001/0004180 A1 | | 6/2001 | Kishimoto | |

FOREIGN PATENT DOCUMENTS

| | | |
|---|---|---|
| DE | 100 07 455 A1 | 9/2000 |
| JP | 2-148815 | 6/1990 |
| JP | 6-342864 | 12/1994 |
| JP | 2000-310990 | 11/2000 |
| JP | 2000-312398 | 11/2000 |
| JP | 2001-95094 | 4/2001 |
| KR | 2001-0062423 | 7/2001 |

OTHER PUBLICATIONS

English translation of the Notice of Submission of Argument Issued in a Korean Application Number 10–2002–0038557 and dated Feb. 24, 2005.

* cited by examiner

*Primary Examiner*—Huyen Le
*Assistant Examiner*—Tuan D. Nguyen
(74) *Attorney, Agent, or Firm*—Keating & Bennett, LLP

(57) ABSTRACT

A piezoelectric electroacoustic transducer includes a substantially rectangular piezoelectric diaphragm having electrodes and flexurally vibrating in response to application of an alternating signal between the electrodes, a resin case having a supporting member disposed inside sidewalls of the case for supporting the diaphragm, terminals insert-molded in the case so as to have internal connections exposed in the supporting member and external connections exposed on the external surface of the case, a conductive adhesive for electrically connecting the electrodes of the diaphragm to the internal connections of the terminals, an elastic sealant for sealing a gap between the external periphery of the diaphragm and the internal periphery of the case, and a lid plate for closing an opening of the case. The terminals are pressed terminals, which are made by punching a metallic plate so that a flash-producing surface is to be the lower surface, and flashes on both respective side-edges of the internal connections are embedded inside the supporting member of the case so that the top surfaces of the internal connections are flush with the surface of the supporting member, and the external connections of the terminals are bent toward the bottom surface of the case via the side surfaces thereof.

10 Claims, 5 Drawing Sheets

PIEZOELECTRIC ELECTROACOUSTIC TRANSDUCER AND MANUFACTURING METHOD OF THE SAME

BACKGROUND OF THE INVENTION

1. Field of the Invention

The present invention relates to a piezoelectric electroacoustic transducer that is suitable for surface mounting and a manufacturing method thereof, and in particular relates to a structure of terminals thereof.

2. Description of the Related Art

In electronic devices, electronic home appliances, portable telephones, and other such electronic devices, piezoelectric electroacoustic transducers have been widely used as a piezoelectric buzzer or piezoelectric receiver for producing an alarm sound or an operating sound. A piezoelectric electroacoustic transducer of this type generally includes a circular piezoelectric element bonded to one surface of a circular metallic plate to form a unimorph-type diaphragm, and the periphery of the metallic plate is mounted on a circular case using silicone rubber while an opening of the case is closed with a cover.

However, when using a circular diaphragm, there has been a problem of low production efficiency, low acoustic conversion efficiency, and moreover, difficulty in miniaturizing the piezoelectric electroacoustic transducer.

A piezoelectric electroacoustic transducer is described in Japanese Unexamined Patent Application Publication No. 2000-310990 as improving production efficiency and acoustic conversion efficiency, and can be miniaturized by using a rectangular diaphragm. The piezoelectric electroacoustic transducer includes a rectangular piezoelectric diaphragm, an insulating case having a bottom wall, four sidewalls, and a supporting member, which is disposed inside between two of the sidewalls opposing each other for supporting the diaphragm, the supporting member being provided with first and second conductive members formed therein for external connection, and a lid plate having holes formed thereon for releasing sound. The diaphragm is accommodated within the case, where two opposite sides of the diaphragm are fixed to the supporting member with an adhesive or an elastic sealant, while gaps between the remaining two sides of the diaphragm and the case are sealed with the elastic sealant, so that the diaphragm and the first and second conductive parts are electrically connected together with a conductive adhesive, and the lid plate is bonded on the open end of the sidewalls of the case.

The above-mentioned Publication, as shown in FIGS. 12 to 15 of the Publication, discloses a method for fixing the terminal to the case such that the terminal is insert-molded along the bottom surface of the case in advance, and then, the end portion of the terminal is bent upwardly along the side wall of the longer side of the case. In this case, it may be difficult to insert-mold because of the complexity of the terminal configuration and it may be difficult to form a fillet for soldering because of a small area of the terminal exposed on the side surface of the case.

The terminal is formed substantially straight during insert molding, and after the insert molding, an external connection protruding from the case is bent toward the bottom surface of the case via the side surface thereof so as to be able to form a terminal suitable for surface mounting. This structure has an advantage that a fillet for soldering is readily formed, because the shape of the terminal is simple and furthermore the external connection of the terminal is bent toward the bottom surface via the side surface.

However, in the structure described above, since the internal connection of the terminal is exposed in the supporting member of the case while the external connection is protruded outside the case, when bending the external connection toward the bottom surface via the side surface, the bending stress spreads also toward the internal connection, so that a loose part may be produced in the internal connection. Therefore, when connecting the diaphragm onto the internal connection, there may be a problem that the diaphragm is not stabilized so that sound pressure characteristics are degraded.

For the terminal, a pressed terminal punched from a metallic plate is generally used, wherein a flash is inevitably produced so that when the flash is exposed on a soldering surface of the external connection, a defect such as a loose part may be produced during mounting.

SUMMARY OF THE INVENTION

In order to overcome the problems described above, preferred embodiments of the present invention provide a piezoelectric electroacoustic transducer and a manufacturing method thereof capable of eliminating a defect such as loosening during mounting while preventing loosening in internal connections of terminals by using a flash.

A first preferred embodiment of the present invention provides a piezoelectric electroacoustic transducer including a substantially rectangular piezoelectric diaphragm having electrodes and flexurally vibrating in response to application of an alternating signal between the electrodes, a resin case having a supporting member disposed inside sidewalls of the case for supporting the piezoelectric diaphragm, terminals insert-molded in the case so as to have internal connections exposed in the supporting member and external connections exposed on the external surface of the case, a conductive adhesive for electrically connecting the electrodes of the piezoelectric diaphragm to the internal connections of the terminals, an elastic sealant for sealing a gap between the external periphery of the piezoelectric diaphragm and the internal periphery of the case, and a lid plate for closing an opening of the case, wherein the terminals are pressed terminals which are made by punching a metallic plate so that a flash-producing surface is to be the lower surface thereof, wherein flashes on both respective side-edges of the internal connections are embedded inside the supporting member of the case so that the top surfaces of the internal connections are flush with the surface of the supporting member, and wherein the external connections of the terminals are bent toward the bottom surface of the case via the side surfaces thereof.

A second preferred embodiment of the present invention provides a method for manufacturing a piezoelectric electroacoustic transducer, including the steps of preparing a substantially rectangular piezoelectric diaphragm having electrodes and flexurally vibrating in response to application of an alternating signal between the electrodes, preparing a resin case having a supporting member disposed inside sidewalls of the case for supporting the piezoelectric diaphragm and terminals insert-molded in the case so as to have internal connections exposed in the supporting member and external connections exposed on the external surface of the case, supporting two opposing sides of the piezoelectric diaphragm on the supporting member by accommodating the piezoelectric diaphragm inside the case, electrically connecting the electrodes of the piezoelectric diaphragm to the internal connections of the terminals with a conductive adhesive, sealing a gap between the external periphery of the piezoelectric diaphragm and the internal periphery of the case with an elastic sealant, and closing an opening of the case with a lid plate, wherein the terminals are pressed terminals which are made by punching a metallic plate so that a flash-producing surface is to be the lower surface thereof, wherein flashes on both respective side-edges of the internal connections are embedded inside the supporting member of the case so that the top surfaces of the internal connections are flush with the surface of the supporting member, and wherein the external connections of the terminals are laterally protruded substantially straight from the case during insert molding, and after the insert molding, the external connections are bent toward the bottom surface of the case via the side surfaces thereof.

First, the substantially rectangular piezoelectric diaphragm and the resin case having the terminals insert-molded therein are prepared. The piezoelectric diaphragm is accommodated within the case so as to be supported on the supporting member of the case, and the electrodes of the piezoelectric diaphragm and the internal connections of the terminals are electrically connected together via the elastic adhesive. After sealing the gap between the external periphery of the piezoelectric diaphragm and the internal periphery of the case with the elastic sealant, the opening of the case is closed. When insert-molding the terminals to the case, the terminals are directed so that the flash-producing surface thereof are to be the lower surface thereof, and the flashes on both respective side-edges of the internal connections are embedded inside the supporting member of the case so that the top surfaces of the internal connections of the terminals are flush with the surface of the supporting member of the case. Then, the external connections of the terminals, which are laterally protruded substantially straight from the case during insert molding, are bent toward the bottom surface of the case via the side surfaces thereof after the insert molding.

With such a configuration, the stress produced by bending the external connections spreads also to the internal connections. However, since the flashes of the internal connections are embedded within the supporting member of the case, loosening of the internal connections is reliably prevented so as to prevent the sound-pressure characteristics from degrading when the piezoelectric diaphragm is connected. Since the flash is not exposed in the internal connections, the reliability of the connection to the piezoelectric diaphragm is also greatly increased.

On the other hand, the external connections of the terminals are bent so as to direct the flashes inside, so that the flash is not exposed in a soldering surface of the external connections, preventing a defect such as the loosening during mounting. Since the external connections are bent toward the bottom surface of the case via the side surfaces thereof, a fillet for soldering can be easily formed while the terminal is easily heated with a soldering bit.

According to preferred embodiments of the present invention, the piezoelectric diaphragm may be directly brought in contact on the internal connections of the terminals or the both may be slightly separated from each other so as to be connected together with the conductive adhesive.

Also, the piezoelectric diaphragm may be mechanically fixed to the supporting member of the case with an adhesive other than the conductive adhesive and elastic sealant.

The piezoelectric diaphragm is not limited to the unimorph-type diaphragm, in which the piezoelectric ceramic plate is bonded on one surface of the metallic plate. Alternatively, a bimorph-type diaphragm may be used, in which a plurality of piezoelectric ceramic layers are deposited.

Other features, elements, characteristics and advantages of the present invention will become more apparent from the following detailed description of preferred embodiments thereof with reference to the attached drawings.

DETAILED DESCRIPTION OF PREFERRED EMBODIMENTS

FIGS. 1 to 4 show a surface-mount sounder that is an example of a piezoelectric electroacoustic transducer according to preferred embodiments of the present invention.

The piezoelectric electroacoustic transducer preferably includes a unimorph-type piezoelectric diaphragm 1, a case 10, and a lid plate 20.

Figure 5:
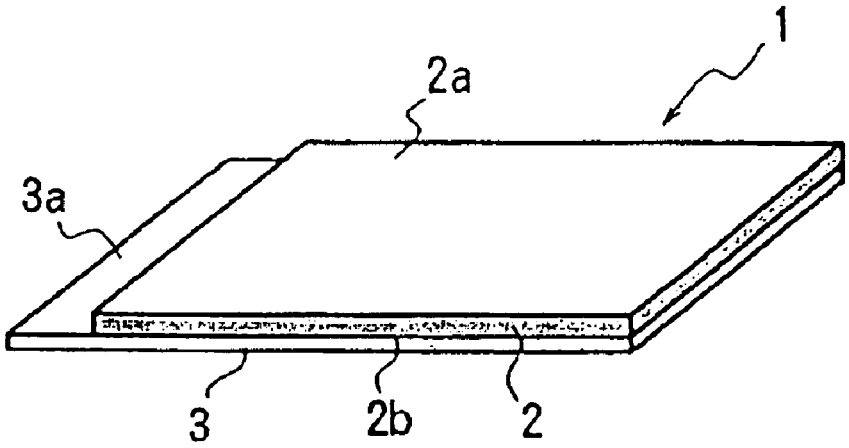
FIG. 5 is a perspective view of a piezoelectric diaphragm for use in the piezoelectric electroacoustic transducer shown in FIG. 1.

The diaphragm 1, as shown in FIG. 5, includes a substantially rectangular piezoelectric plate 2, which is polarized in the thickness direction and has thin-film or thick-film electrodes 2*a* and 2*b* respectively disposed on top and back surfaces thereof, and a substantially rectangular metallic plate 3 with substantially the same width as that of the piezoelectric plate 2 and with a slightly longer length than that thereof, which is faced and bonded on the back-surface electrode 2*b* of the piezoelectric plate 2 via a conductive adhesive or other suitable material. In addition, the metallic plate 3 may be directly joined to the back surface of the piezoelectric plate 2 via the conductive adhesive so as to omit the back-surface electrode 2*b*. According to the present preferred embodiment, the piezoelectric plate 2 is bonded on the metallic plate 3 at a position that is lopsided relative to one side of the metallic plate 3 in the longitudinal direction so as to have an exposure portion 3*a*, in which the metallic plate 3 is exposed, in the longitudinal direction toward the other side of the metallic plate 3.

For the piezoelectric plate 2, a PZT ceramic plate with approximate dimensions of 10 mm×8 mm×50 μm may be used, for example. A material of the metallic plate 3 preferably has high conductivity and spring elasticity as well, so that a metallic plate such as phosphor bronze and 42Ni with approximate dimensions 10 mm×10 mm×50 μm may be used therefor, for example.

Figure 4:
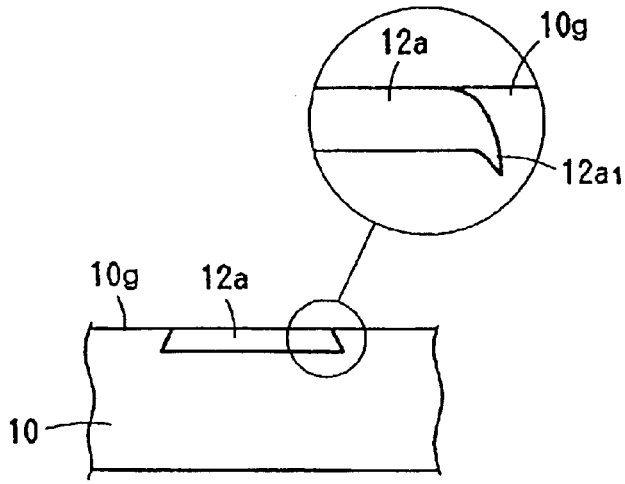
FIG. 4 is a side elevation viewed in the direction of the arrow B of FIG. 3.

The case 10, made of a heat-resistant resin such as an LCP (liquid crystal polymer), SPS (syndiotactic polystyrene), PPS (polyphenylene sulfide), and an epoxy resin, is integrally formed to have a substantially rectangular box-shape having a bottom wall 10*a* and four sidewalls 10*b* to 10*e*. In the internal peripheries of the four sidewalls 10*b* to 10*e*, steps 10*f* are disposed in annular arrangement. In the internal peripheries of the steps 10*f*, an annular supporting member 10*g* is disposed at the position lower by one step. Over the steps 10*f* inside the two opposing sidewalls 10*b* and 10d, internal connections 11*a* and 12*a* of a pair of terminals 11 and 12 are exposed, respectively. The terminals 11 and 12 are formed in the case 10 by insert molding, in which external connections 11*b* and 12*b* protruding outside the case 10 are bent along external surfaces of the sidewalls 10*b* and 10*d* toward the bottom wall 10*a* of the case 10. The terminals 11 and 12 are pressed terminals made by punching a metallic plate so that a flash-producing surface is to be the lower surface thereof, as will be described later, and each of the internal connections 11*a* and 12*a*, as shown in FIG. 4, has a substantially trapezoidal section. Therefore, when the terminals 11 and 12 are insert-molded so that the top surfaces of the internal connections 11*a* and 12*a* are flush with the surface of the supporting member 10*g*, flashes $\mathbf{11}a_1$ and $\mathbf{12}a_1$ ($\mathbf{11}a_1$ is not shown) of both respective sides of the internal connections 11*a* and 12*a* are embedded inside the supporting member 10*g*, the loosening of the internal connections 11*a* and 12*a* is reliably prevented due to its anchoring effect. The bottom surface of the case 10 is provided with grooves 10*h*, into which the external connections 11*b* and 12*b* of the terminals 11 and 12 are fitted. Therefore, the bottom surface of the case 10 is substantially flush with the bottom surfaces of the external connections 11*b* and 12*b*, which are soldering surfaces. Furthermore, since the flash-producing surfaces of the terminals 11 and 12 are arranged to be inside when being folded, the flash cannot be exposed from the soldering surfaces of the external connections 11*b* and 12*b*.

Figure 1:
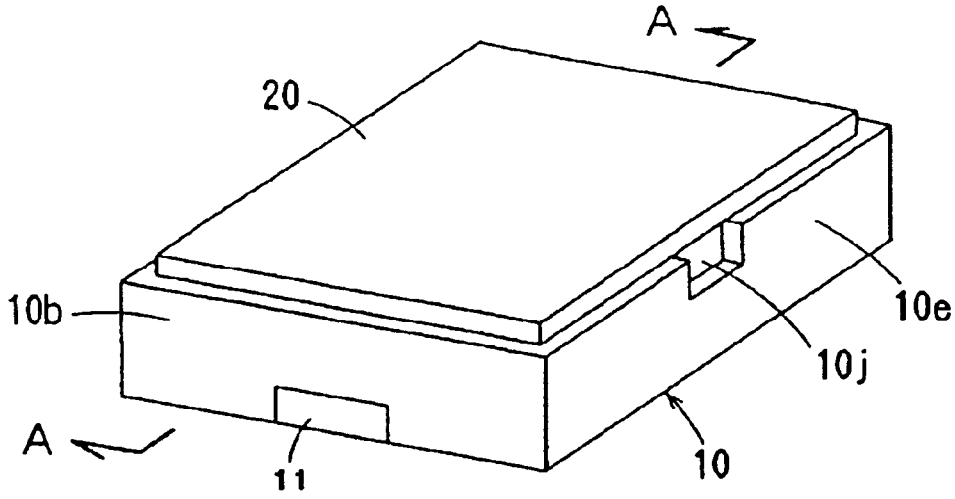
FIG. 1 is a perspective view of a piezoelectric electroacoustic transducer according to a first preferred embodiment of the present invention.
Figure 2:
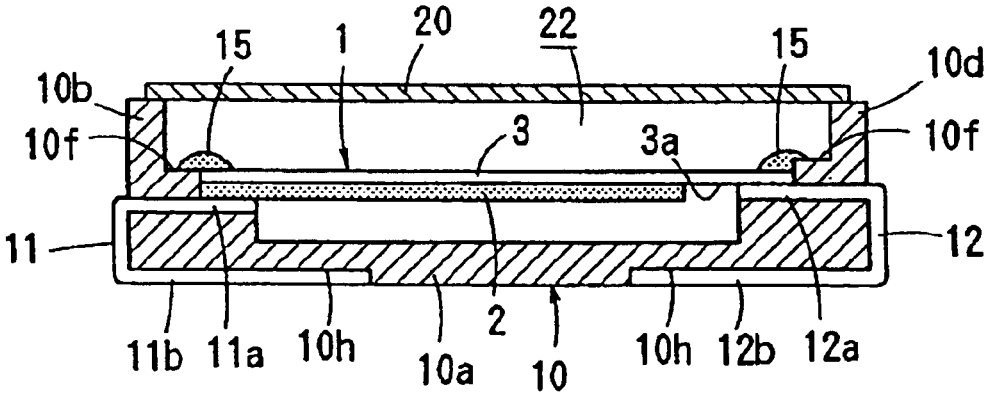
FIG. 2 is a sectional view at the line A—A of FIG. 1.
Figure 3:
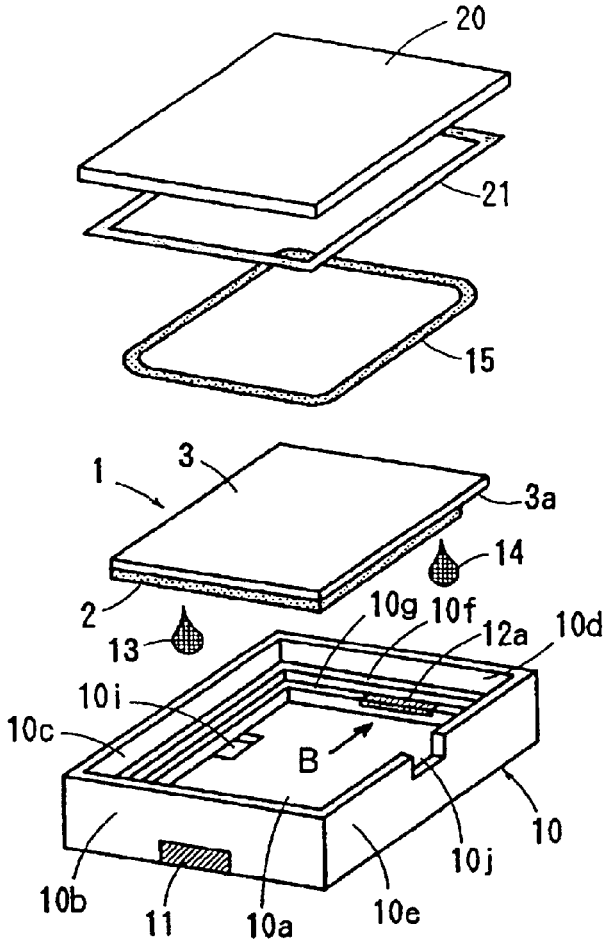
FIG. 3 is an assembly view of the piezoelectric electroacoustic transducer shown in FIG. 1.

In addition, the bottom wall 10*a* of the case 10 is provided with a damping hole 10*i* formed thereon and at the upper edge of the sidewall 10*e*, a cut-out 10*j* to be a second sound-releasing hole is preferably formed (see FIG. 3).

The diaphragm 1 is accommodated within the case 10 so that the piezoelectric plate 2 faces the bottom wall 10*a* of the case 10, and the two shorter sides thereof are placed on the supporting member 10*g*, on which the terminals 11 and 12 are exposed. The surfaces of the internal connections 11*a* and 12*a* of the terminals 11 and 12 are coated with conductive adhesives 13 and 14 in advance, so that the internal connections 11*a* and 12*a* of the terminals 11 and 12 are connected and fixed to the surface electrode 2*a* of the piezoelectric plate 2 and the exposure portion 3*a* of the metallic plate 3, respectively. For the conductive adhesives 13 and 14, a known conductive paste such as an epoxy and urethane paste may be used.

In addition, according to the present preferred embodiment, the diaphragm 1 is preferably arranged so as to direct the piezoelectric plate 2 toward the bottom wall 10*a* of the case 10. However, the diaphragm may be arranged so as to direct the metallic plate 3 toward the bottom wall 10*a* of the case 10. In this case, after placing the diaphragm 1 on the supporting member 10*g*, the conductive adhesives 13 and 14 may be applied.

The gap between the entire periphery of the diaphragm 1 and the internal periphery of the case 10 are sealed with an elastic sealant 15 so that air leakage between the top and back surfaces of the diaphragm 1 is prevented. For the elastic sealant 15, a material having a low Young's modulus after curing such as a silicone adhesive may be preferably used so as not to impede the bending vibration of the diaphragm 1. After sealing and fixing the diaphragm 1 to the case 10, the lid plate 20 is bonded to the upper opening of the case 10 with an adhesive 21. The lid plate 20 is preferably made of the same material as that of the case 10. By bonding the lid plate 20, a resonance space 22 (see FIG. 2) is formed between the lid plate 20 and the diaphragm 1.

In the manner described above, the piezoelectric electroacoustic transducer is completed.

The piezoelectric electroacoustic transducer of the structure described above is surface-mounted on a circuit board, etc. When a predetermined alternating signal (alternating current signal or rectangular-wave signal) is applied to between the terminals 11 and 12 provided in the case 10, the signal is supplied to between the surface electrodes 2*a* and 2*b* of the piezoelectric plate 2 of the diaphragm 1 so as to cause the piezoelectric plate 2 to expand and contract in a planar direction, so that the diaphragm 1 flexually vibrates corresponding to the alternating signal so as to generate a sound wave. The generated sound wave is amplified in the resonance space 22 and released outside via the sound-releasing hole formed between the lid plate 20 and the cut-out 10*j* of the case 10.

A manufacturing method of the case 10 according to the preferred embodiment described above will now be described with reference to FIGS. 6A to 7.

Figure 6A:
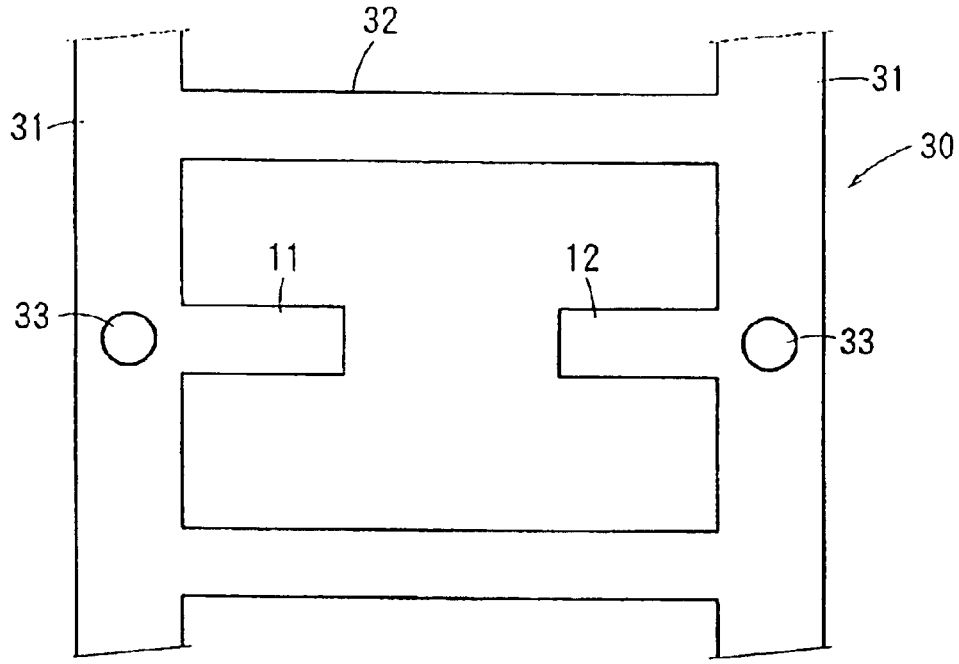
FIGS. 6A and 6B are plan views showing a first half of a manufacturing process of a case.

FIG. 6A shows a punched state of a lead frame 30 from one metallic plate using a press die. Referring to the drawing, numerals 31, 32, and 33 represent a carrier, a tie bar, and a pilot hole, respectively, and elements 11 and 12 of the terminals internally extending from the carriers 31 are integrally formed. The lead frame 30 is pressed so that a flash-producing surface is to be the lower surface thereof.

Figure 6B:
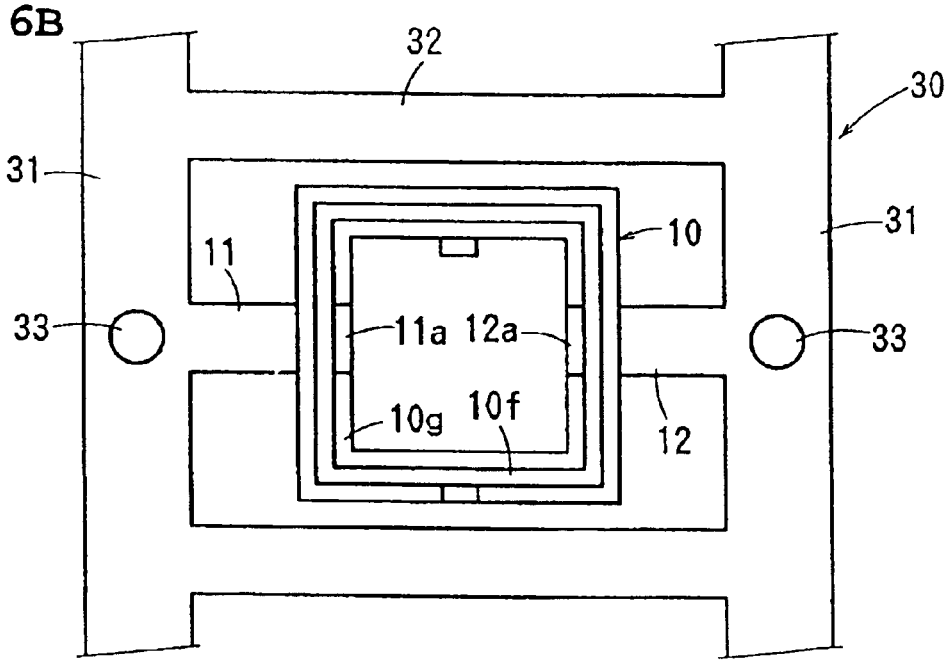

FIG. 6B shows an insert-molded state of the case 10 into the lead frame 30. The internal connections 11*h* and 12*a* of the terminals 11 and 12 are formed so as to be exposed in the supporting member 10*g* of the case 10, and flashes on both side-edges of the internal connections 11*a* and 12*a* are embedded inside the supporting member 10*g*.

Figure 7A:
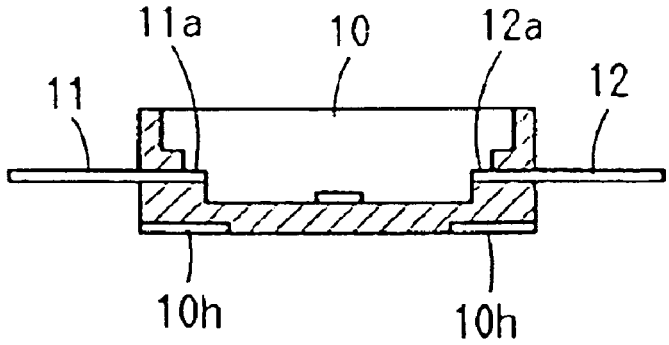
FIGS. 7A to 7C are sectional views showing a second half of a manufacturing process of the case.

FIG. 7A shows a state of the terminals 11 and 12 separated from the carrier 31 of the lead frame 30, wherein the terminals 11 and 12 extend toward both sides of the case 10 horizontally. At this time, flash-producing surfaces of the terminals 11 and 12 face downward.

Figure 7B:
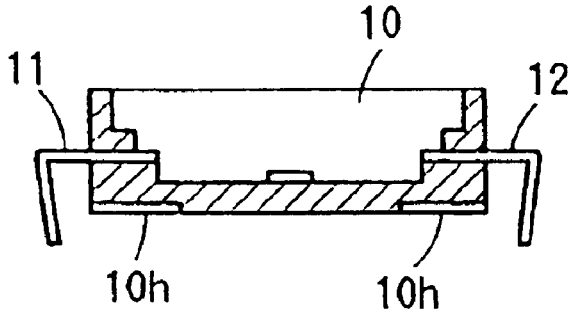

FIG. 7B shows a downwardly bent state of portion of the terminals 11 and 12 protruded from the case 10, which are halves from the mid point toward the tip ends. At this time, preferably, the bending angle may be slightly larger than 90°.

Figure 7C:
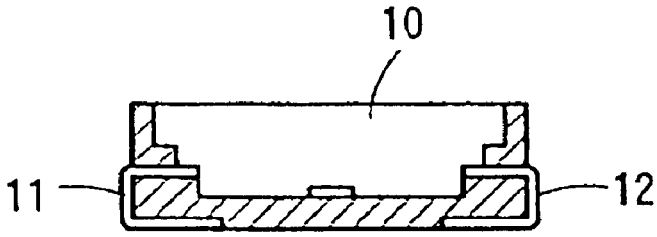

As shown in FIG. 7C, the portions of the terminals 11 and 12 that protrude from the case 10 are bent at the roots thereof, and then internal surfaces of the terminals 11 and 12 are guided along the side surfaces of the case 10. In this state, the bent portions shown in FIG. 7B are fitted into the grooves 10*h* formed on the bottom surface of the case 10, wherein the bending at an angle slightly larger than about 90° as shown in FIG. 7B prevents the ends of the terminals 11 and 12 from being loosened. Moreover, since the flash-producing surfaces of the terminals 11 and 12 face the bottom surface of the case 10, the flash cannot be exposed on a soldering surface.

The manufacturing method of the singular case 10 has been described with reference to FIGS. 6A to 7C. However, it is preferable in a practical manufacturing process that the assembling of the piezoelectric diaphragm 1, applying of the elastic sealant 15, and bonding of the lid plate 20 be performed on the case 10 remaining in a state of being connected to the lead frame 30, and then the terminals 11 and 12 be separated from the lead frame 30 so as to bend the terminals 11 and 12. In this case, since the case 10 is precisely positioned with the pilot hole 33 of the lead frame 30, the manufacturing process of the case 10 can be efficiently performed from the insert-molding to bonding of the lid plate 20.

According to the preferred embodiment described above, the unimorph-type diaphragm 1, in which the piezoelectric plate is bonded on one surface of the metallic plate, is exemplified. However, the diaphragm is not limited to this, and as disclosed in Japanese Unexamined Patent Application Publication No. 2001-95094, for example, the diaphragm may be made by depositing two or three piezoelectric ceramic layers so as to form a deposited structure having external electrodes disposed on both sides of the deposited structure and an internal electrode disposed between ceramic layers. In this case, in the thickness direction of the ceramic layer, the ceramic layer is polarized in the same direction, and by applying an alternating signal to between the external and internal electrodes, the deposited structure can flexurally vibrate.

In this case, the diaphragm has a deposited ceramic structure without a metallic plate and two vibrating regions sequentially arranged in the thickness direction vibrate in directions opposite to each other, so that a larger displacement, i.e., larger sound pressure can be obtained in comparison with the unimorph-type diaphragm.

The shape of the terminals 11 and 12 is not limited to a plate with a predetermined width as in the present preferred embodiment, and the internal connection may be two-forked, for example, or an opening may be formed in an intermediate portion of the terminal embedded within the case so as to increase a terminal-holding force by the case.

According to the present preferred embodiment, the internal connections of the terminals are exposed on the supporting member of the case, and the diaphragm is placed and fixed thereon. Alternatively, a part for supporting the diaphragm is extended inside from the supporting member, so that the diaphragm is located thereon and spaced away from the internal connections.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A piezoelectric electroacoustic transducer comprising:

a substantially rectangular piezoelectric diaphragm having electrodes and flexurally vibrating in response to application of an alternating signal between the electrodes;

a case having a supporting member disposed inside sidewalls of the case for supporting the piezoelectric diaphragm;

terminals insert-molded in the case so as to have internal connections exposed in the supporting member and external connections exposed on the external surface of the case;

a conductive adhesive for electrically connecting the electrodes of the piezoelectric diaphragm to the internal connections of the terminals;

an elastic sealant for sealing a gap between an external periphery of the piezoelectric diaphragm and an internal periphery of the case; and a lid plate for closing an opening of the case; wherein the terminals are pressed terminals made of a punched metallic plate so that a flash-producing surface is to be a lower surface thereof, flashes on both respective side-edges of the internal connections are embedded inside the supporting member of the case so that the top surfaces of the internal connections are flush with the surface of the supporting member, and the external connections of the terminals are bent toward the bottom surface of the case via the side surfaces thereof.

2. A piezoelectric transducer according to claim 1, wherein the case is made of resin.

3. A piezoelectric transducer according to claim 1, wherein the piezoelectric diaphragm is a unimorph-type piezoelectric diaphragm.

4. A piezoelectric transducer according to claim 1, wherein the piezoelectric diaphragm includes at least two substantially rectangular piezoelectric plates.

5. A piezoelectric transducer according to claim 4, wherein one of the at least two substantially rectangular piezoelectric plates is longer than the other of the least two substantially rectangular piezoelectric plates.

6. A piezoelectric transducer according to claim 4, further comprising a metallic plate provided in the piezoelectric diaphragm and being arranged such that one of the at least two substantially rectangular piezoelectric plates is bonded on the metallic plate at a position that is lopsided relative to one side of the metallic plate in the longitudinal direction so as to provide an exposed portion of the metallic plate.

7. A piezoelectric transducer according to claim 6, wherein said one of the least two substantially rectangular piezoelectric plates is a PZT ceramic plate and the metal plate is made of one of phosphor bronze and 42Ni.

8. A piezoelectric transducer according to claim 1, wherein in the internal peripheries of the sidewalls of the case, steps are disposed in an annular arrangement.

9. A piezoelectric transducer according to claim 1, wherein in the internal peripheries of the steps, the supporting member is disposed at a position that is lower by one step.

10. A piezoelectric transducer according to claim 1, wherein a bottom surface of the case has grooves into which the external connections of the terminals are fitted.

* * * * *